US007997939B2

(12) United States Patent
Akaiwa et al.

(10) Patent No.: US 7,997,939 B2
(45) Date of Patent: Aug. 16, 2011

(54) PLUG

(75) Inventors: Taku Akaiwa, Kanagawa (JP); Susumu Shinozaki, Tokyo (JP); Takeshi Matsuda, Kanagawa (JP); Tatsuo Kato, Kanagawa (JP); Masaji Komuro, Kanagawa (JP); Kenji Nakazawa, Tokyo (JP); Kenji Hatano, Kanagawa (JP); Yoshitaka Kimura, Kanagawa (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 12/845,504

(22) Filed: Jul. 28, 2010

(65) Prior Publication Data

US 2011/0136392 A1 Jun. 9, 2011

(30) Foreign Application Priority Data

Dec. 8, 2009 (JP) ..... 2009-278223

(51) Int. Cl.
*H01R 24/04* (2006.01)

(52) U.S. Cl. ..... 439/669

(58) Field of Classification Search ..... 439/669, 439/63, 581

See application file for complete search history.

(56) References Cited

U.S. PATENT DOCUMENTS 6,439,933 B1 8/2002 Moji
6,616,487 B1 9/2003 Lai
2008/0090465 A1* 4/2008 Matsumoto et al. ..... 439/669
2009/0311915 A1* 12/2009 Stiehl ..... 439/669
2010/0197172 A1* 8/2010 Yudate ..... 439/669

FOREIGN PATENT DOCUMENTS

EP 1898499 A2 3/2008
JP 2002-134238 A 5/2002
WO 2009/091495 A2 7/2009

OTHER PUBLICATIONS

European Search Report dated Mar. 10, 2011, in a counterpart European patent application No. 10194189.6 for Examiner consideration, citing U.S. Patent Nos. 1-2 and U.S. Patent Application Publication Nos. 1-2, and Foreign Patent document Nos. 1-2 listed above.

* cited by examiner

*Primary Examiner* — Gary F. Paumen
(74) *Attorney, Agent, or Firm* — Chen Yoshimura LLP

(57) ABSTRACT

A plug includes a plug housing and a metal terminal group. The metal terminal group includes a mating electrode group on the first end side thereof and a connection electrode group on the second end side, the mating electrode group including mating electrode sections that are disposed with an insulating resin interposed therebetween and are to be in contact with the contacts of a mating jack, the connection electrode group including connection electrode sections that are disposed with an insulating resin interposed therebetween and are connected to the electrodes of a connection member. The mating electrode sections are disposed coaxially with an axis P of the plug, and at least two of the connection electrode sections are disposed around the axis P so as to surround the axis P side by side.

6 Claims, 5 Drawing Sheets

(1)

(2)

PLUG

CROSS REFERENCE TO RELATED APPLICATIONS

The contents of the following Japanese patent application is incorporated herein by reference, No. 2009-278223 filed on Dec. 8, 2009.

BACKGROUND

1. Technical Field

The present invention relates mainly to a connection structure of a single-head plug to be connected to a cable.

2. Description of the Related Art

In conventional single-head plugs to be connected to a cable, the electrodes thereof are directly connected to connection electrode sections extending to the connection area of the plug by, for example, soldering.

For example, in Japanese Patent Application Publication No. 2002-134238, the connection electrode sections of a plug are coaxially arranged in its connection area so as to correspond with the coaxial arrangement of plug electrodes to be connected to the contacts of a jack that mates with the plug. Although not explicitly described, the connection electrode sections are directly soldered to a cable.

In 4-pole plugs (ϕ: 3.5 mm) often used for the audio terminals of portable devices, cylindrical connection electrode sections having different diameters are arranged along the axial line. Therefore, inevitably, such plugs have large axial lengths. As described above, a cable is directly soldered to the connection electrode sections. However, since the overall size of such plugs is small, the size of their connection electrode sections is also small. Therefore, workability is poor, and the routing of the soldered cable is limited. This results in an increase in man-hour, a reduction in yield, and limitations on shape.

SUMMARY

The present invention has been made in view of the foregoing problems in the conventional technology, and it is an object of the invention to provide a connection structure of contacts that can maintain a connection state in a reliable manner.

A first aspect of the present invention provides a plug (2) comprising a plug housing (20) and a metal terminal group (21), wherein the metal terminal group (21) includes a mating electrode group (22) on a first end side of the metal terminal group and a connection electrode group (23) on a second end side of the metal terminal group, the mating electrode group (22) including mating electrode sections (22A, 22B, 22C, and 22D) that are disposed with an insulator interposed therebetween and are to be in contact with contacts of a mating jack, the connection electrode group (23) including connection electrode sections (23A, 23B, 23C, and 23D) that are disposed with an insulator interposed therebetween and are to be connected to electrodes of a connection member, wherein the mating electrode sections (22A, 22B, 22C, and 22D) are disposed coaxially with an axis (P) of the plug (2), and wherein at least two of the connection electrode sections (23A, 23B, 23C, and 23D) are disposed around the axis (P) so as to surround the axis (P) side by side.

With this configuration, at least one of the connection electrode sections can be disposed at the same axial position as another connection electrode section such that these connection electrode sections are disposed to surround the axis side by side.

A second aspect of the present invention provides the plug according to the first aspect, wherein the at least two of the connection electrode sections surrounding the axis (P) side by side are configured such that a first one of the at least two of the connection electrode sections is provided as a rear end portion of one out of the metal terminal group (21), which has a larger diameter than the other and has the rear end portion including a cut-our portion in part, and that a second one of the at least two of the connection electrode sections is provided as a rear end portion of the other out of the metal terminal group (21), which has a smaller diameter than the one and has the rear end portion disposed in the cut-out portion, and wherein the at least two of the connection electrode sections are disposed with radial step portions (20B) of the insulator interposed therebetween.

With this configuration, the at least two of the connection electrode sections located in the rear end portion of the metal terminals arranged around the axis can be arranged around the axis so as to surround the axis side by side using a simple structure. Moreover, since the first and second ones of the at least two of the connection electrode sections are disposed with the radial step portions of the insulator interposed therebetween, the flow of solder during soldering can be intercepted by the radial step portions.

A third aspect of the present invention provides the plug according to the first or second aspect, wherein the metal terminal group comprises first, second and third metal terminals, first, second, and third mating electrode sections are disposed in that order from a rear side of the mating electrode group to a front side thereof, first and second connection electrode sections are disposed in a front end portion of the connection electrode group so as to surround the axis side by side, the first metal terminal has a largest diameter and has a rear end portion serving as the first connection electrode section that is partially cut out to form a cut-out portion, the second metal terminal has a second largest diameter and has a rear end portion serving as the second connection electrode section and disposed in the cut-out portion, the third metal terminal has a smallest diameter and has a rear end portion serving as a third connection electrode section that is disposed in a rear end portion of the connection electrode group, the first and second connection electrode sections are disposed with radial step portions of the insulator interposed therebetween, and an axial step portion is provided between the third connection electrode section and each of the first and second connection electrode sections With this configuration, even when the plug is a 3-pole plug, the first and second connection electrode sections in the rear end portions of the metal terminals arranged around the axis can be arranged around the axis so as to surround the axis side by side using a simple structure. Since the first and second connection electrode sections are disposed with the insulator interposed therebetween, the flow of solder during soldering can be intercepted by the radial step portions. When the third connection electrode section and the first and second connection electrode sections are soldered, the flow of the solder can be intercepted by the axial step portion.

A fourth aspect of the present invention provides the plug according to the first aspect, wherein the metal terminal group (21) comprises first to fourth metal terminals (21A, 21B, 21C, and 21D), first, second, third, and fourth mating electrode sections (22A, 22B, 22C, and 22D) are disposed in that order from a rear side of the mating electrode group (22) to a front side thereof, the first metal terminal (21A) has a largest diameter and has a rear end serving as a first connection electrode section (23A) that is disposed in a front end potion of the connection electrode group (23), the second metal terminal (21B) has a second largest diameter and has a rear end portion that is partially cut out to form a cut-out portion, a second connection electrode section (23B) is the rear end portion excluding the cut-out portion of the second metal terminal (21B) and is disposed on a rear side of the first connection electrode section (23A), the third metal terminal (21C) has a second smallest diameter and has a rear end portion serving as a third connection electrode section (23C) that is disposed in the cut-out portion, the fourth metal terminal (21D) has a smallest diameter and has a rear end portion serving as a fourth connection electrode section (23D) that is exposed at a rear end portion of the connection electrode group (23), an axial step portion (20A) is provided between the first connection electrode section (23A) and each of the second and third connection electrode sections (23B and 23C), radial step portions (20B) are provided between the second and third connection electrode sections (23B and 23C), and another axial step portion (20A) is provided between the fourth connection electrode section (23D) and each of the second and third connection electrode sections (23B and 23C).

With this configuration, even when the plug is a 4-pole plug, the second and third connection electrode sections can be arranged around the axis so as to surround the axis side by side using a simple structure. Since the second and third connection electrode sections are disposed with the insulator interposed therebetween, the flow of solder during soldering can be intercepted by the radial step portions. When the first, second, and third connection electrode sections are soldered, the flow of the solder can be intercepted by the axial step portion. In addition, when the fourth, second, and third connection electrode sections are soldered, the flow of the solder can be intercepted by the other axial step portion.

A fifth aspect of the present invention provides the plug according to any one of the first to fourth aspects, the plug further comprising a substrate (4) as the connection member.

In this case, a plurality of cables can be more easily soldered to the substrate than to the connection electrode sections directly. In addition, there is no cable soldered to the connection electrode sections and routed around the axis in a complex manner.

A sixth aspect of the present invention provides the plug according to the fifth aspect, wherein the substrate (4) has a cut-out portion (42) and includes electrodes (41A, 41B, 41C, and 41D) having flat surfaces and disposed on an inner surface of the cut-out portion (42) or in a periphery of the cut-out portion (42), the connection electrode group (23) is accommodated in the cut-out portion (42) of the substrate (4), the connection electrode sections (23A, 23B, 23C, and 23D) have cylindrical curved surfaces and face the electrodes (41A, 41B, 41C, and 41D) of the substrate (4), and the curved surfaces are soldered to the flat surfaces.

With this configuration, since the connection electrode sections are accommodated into the cut-out portion of the substrate, the electrodes of the substrate can be easily soldered to the connection electrode sections. In addition, since the connection electrode sections having curved surfaces are soldered to the adjacent flat electrodes of the substrate, good solder fillets can be formed.

A seventh aspect of the present invention provides the plug according to the sixth aspect, wherein at least one of the connection electrode sections (23A, 23B, 23C, and 23D) has a shape extending on front and rear sides of the substrate (4) so as to surround the axis (P).

With this configuration, the at least one of the connection electrode sections can be positioned on the front and rear sides of the substrate and on the inner surface of the cut-out portion.

An eighth aspect of the present invention provides the plug according to the sixth or seventh aspect, wherein each adjacent pair of the connection electrode sections (23A, 23B, 23C, and 23D) adjacent in a direction of the axis (P) are soldered on different surfaces on the front and rear sides of the substrate (4).

With this configuration, since the each adjacent pair of the connection electrode sections can be soldered on different surfaces on the front and rear sides, the soldered points can be spaced apart from each other.

In the plug of the first aspect of the present invention, the total axial length of the connection electrode sections can be reduced by the length of at least one connection electrode section.

In the second aspect of the present invention, the total axial length of the connection electrode sections can be reduced by the length of at least one connection electrode section using a simple structure. Moreover, the connection electrode sections arranged around the axis can be insulated from each other in a reliable manner.

In the third aspect of the present invention, even when the plug is a 3-pole plug, the total axial length of the connection electrode sections can be reduced by the length of at least one connection electrode section using a simple structure.

More specifically, the total axial length can be reduced by a length corresponding to the length of the axially overlapping portion. Therefore, even when the connection electrode sections are fully or partially overlapped, the effects of the invention can be achieved. In addition, the three connection electrode sections 23A, 23B, and 23C can be insulated from each other in a reliable manner.

In the fourth aspect of the present invention, even when the plug is a 4-pole plug, the total axial length of the connection electrode sections can be reduced by the length of at least one connection electrode section using a simple structure.

More specifically, the total axial length can be reduced by a length corresponding to the length the axially overlapping portion. Therefore, even when the connection electrode sections are fully or partially overlapped, the effects of the invention can be achieved. In addition, the four connection electrode sections 23A, 23B, 23C, and 23D can be insulated from each other in a reliable manner.

In the fifth aspect of the present invention, the workability is improved, and soldering can be easily performed even when the connection electrode sections are reduced in size. In addition, the structure around the connection electrode sections is not complicated.

In the sixth aspect of the present invention, the connection electrode sections can be easily soldered to the electrodes of the substrate.

In addition, the mounting strength of the substrate can be ensured.

In the seventh aspect of the present invention, each of the connection electrode sections can be appropriately connected to one of the front and rear surfaces of the substrate and the inner surface of the cut-out portion, so that the design flexibility can be improved.

In the eighth aspect of the present invention, the adjacent connection electrode sections can be insulated from each other in a reliable manner.

The summary clause does not necessarily describe all necessary features of the embodiments of the present invention.

DESCRIPTION OF EXEMPLARY EMBODIMENTS

Figure 1:
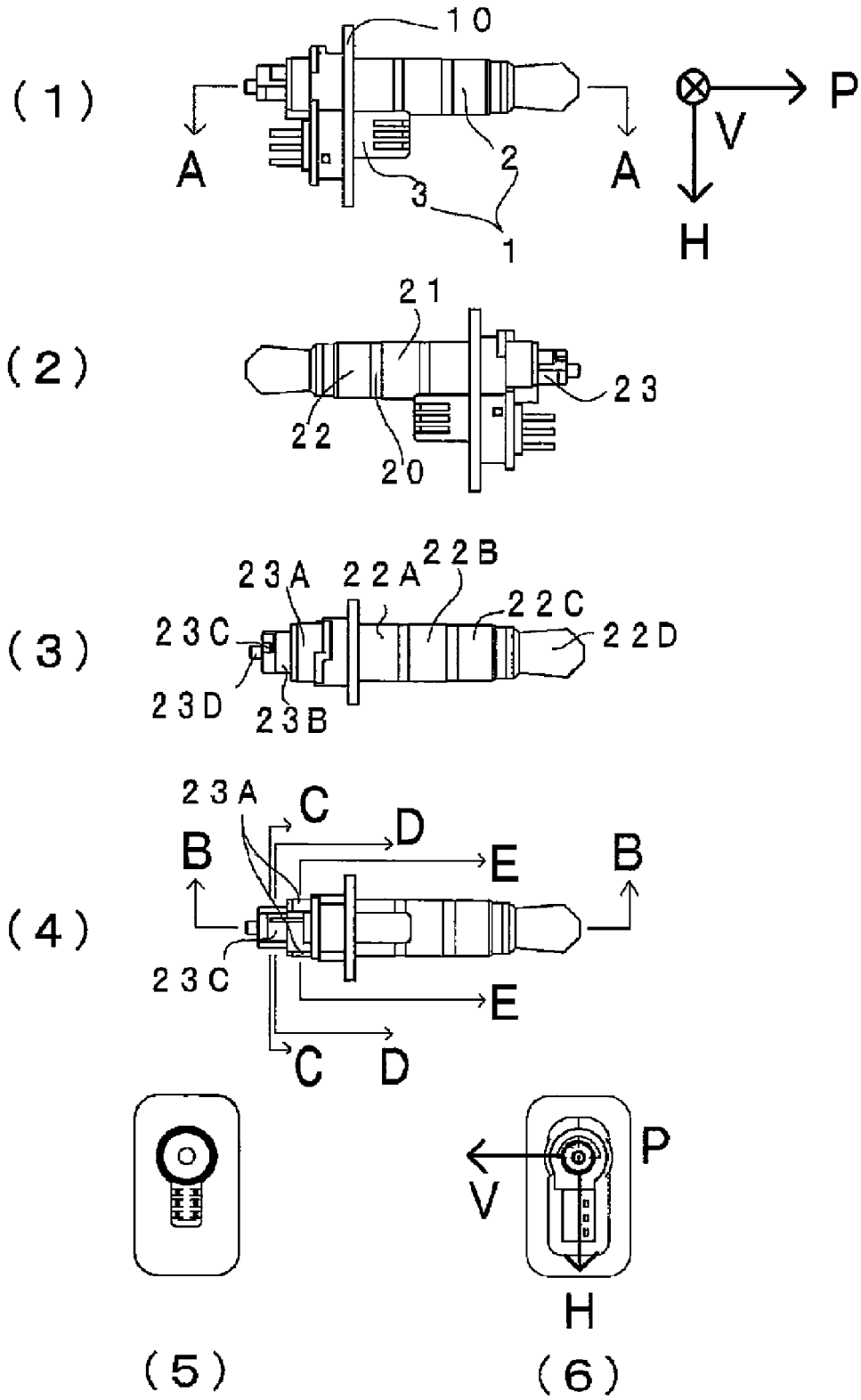
FIG. 1 shows (1) a front view of a composite connector according to an embodiment, (2) a rear view, (3) a top view, (4) a bottom view, (5) a right-side view and (6) a left-side view.
Figure 2:
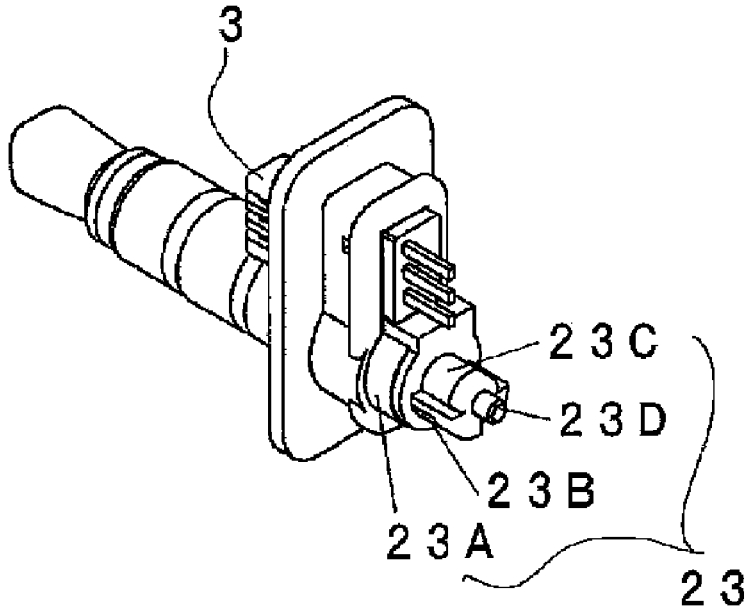
FIG. 2 shows (1) a front-bottom-left side perspective view of the composite connector according to the embodiment and (2) a rear-top-right perspective view.
Figure 2:
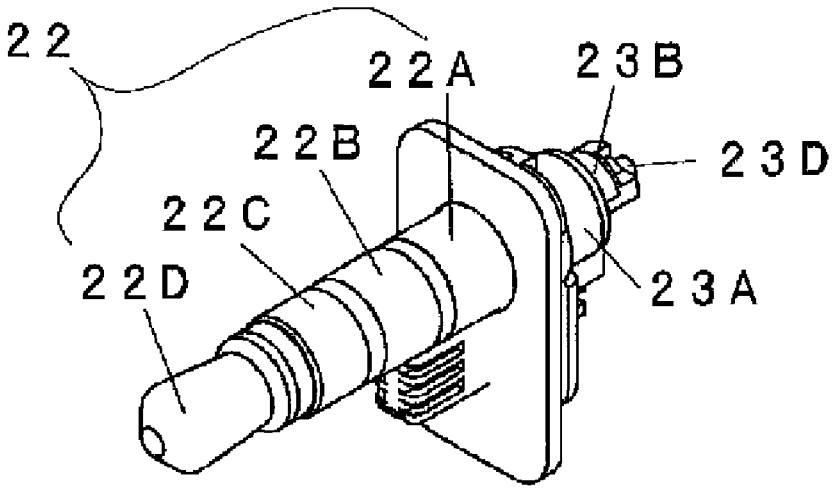

Hereinafter, the best mode of the present invention will be described by way of an exemplary embodiment.

First Embodiment

A first embodiment will be described with reference to FIGS. 1 to 4.

A plug according to the present invention is disposed in a composite connector 1 including a multi-pole connector 3.

The composite connector 1 includes: a housing 10 formed of an insulator such as an insulating resin; a plug 2 formed integrally with the housing 10; and the multi-pole connector 3 incorporated with the housing 10. A mating composite connector (not shown) that mates with the composite connector 1 includes a jack (not shown) and a multi-pole socket (not shown). An electronic device connected to the composite connector 1 is connected to an electronic device connected to the mating composite connector by fitting the composite connector 1 into the mating composite connector, i.e., fitting the plug 2 into the jack and fitting the multi-pole connector 3 into the multi-pole socket. The plug 2 includes: a mating electrode group 22 that is disposed on the front side thereof and to be fitted into the mating jack; and a connection electrode group 23 that is disposed on the rear side and connected (for example, soldered) to a substrate 4 to which a cable (not shown) connected to an electronic device is connected.

Figure 3:
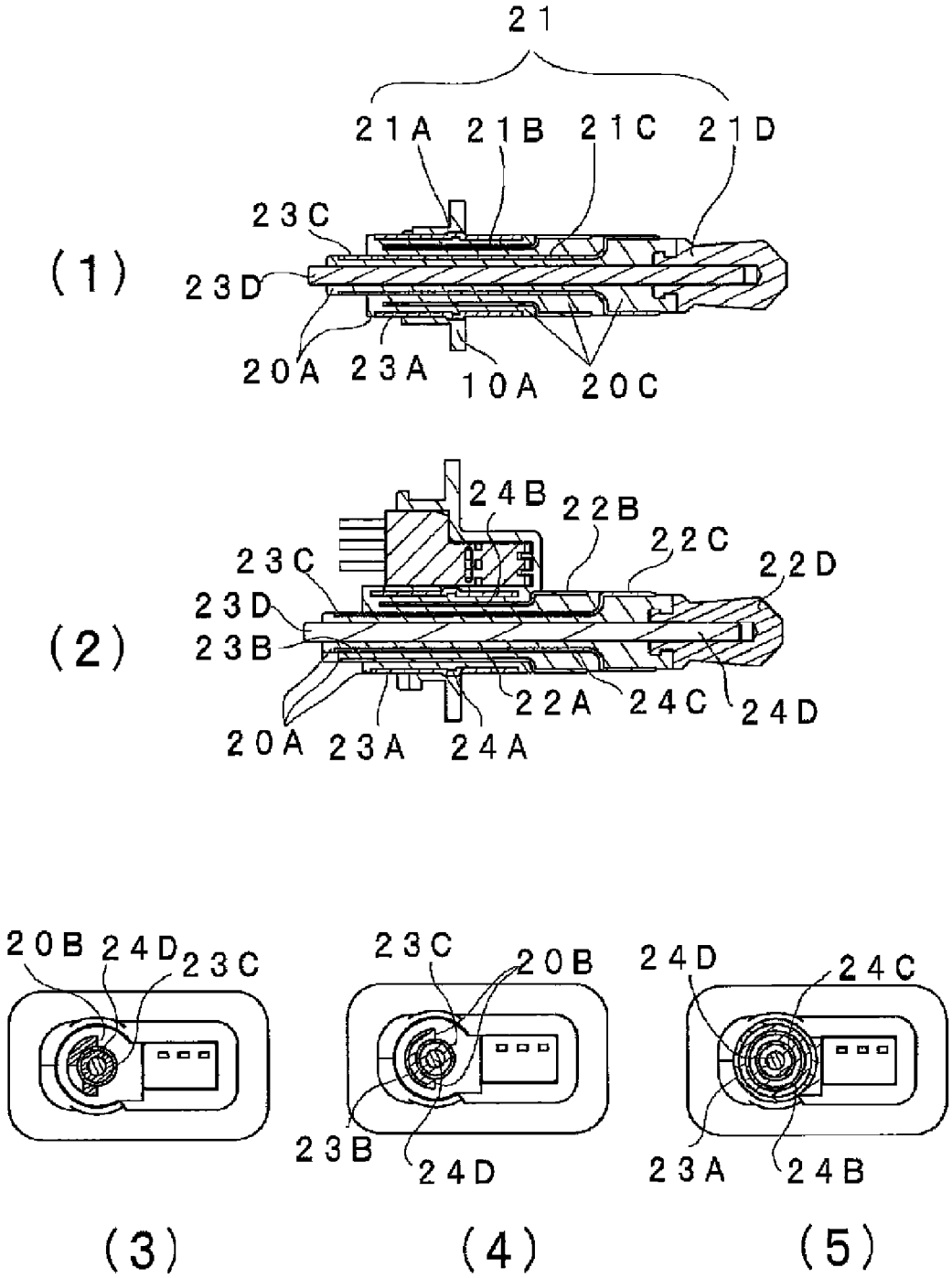
FIG. 3 shows (1) a cross sectional view taken along A-A in FIG. 1(1), (2) a cross sectional view taken along B-B, (3) a cross sectional view taken along C-C, (4) a cross sectional view taken along D-D and (5) a cross sectional view taken along E-E.
Figure 4:
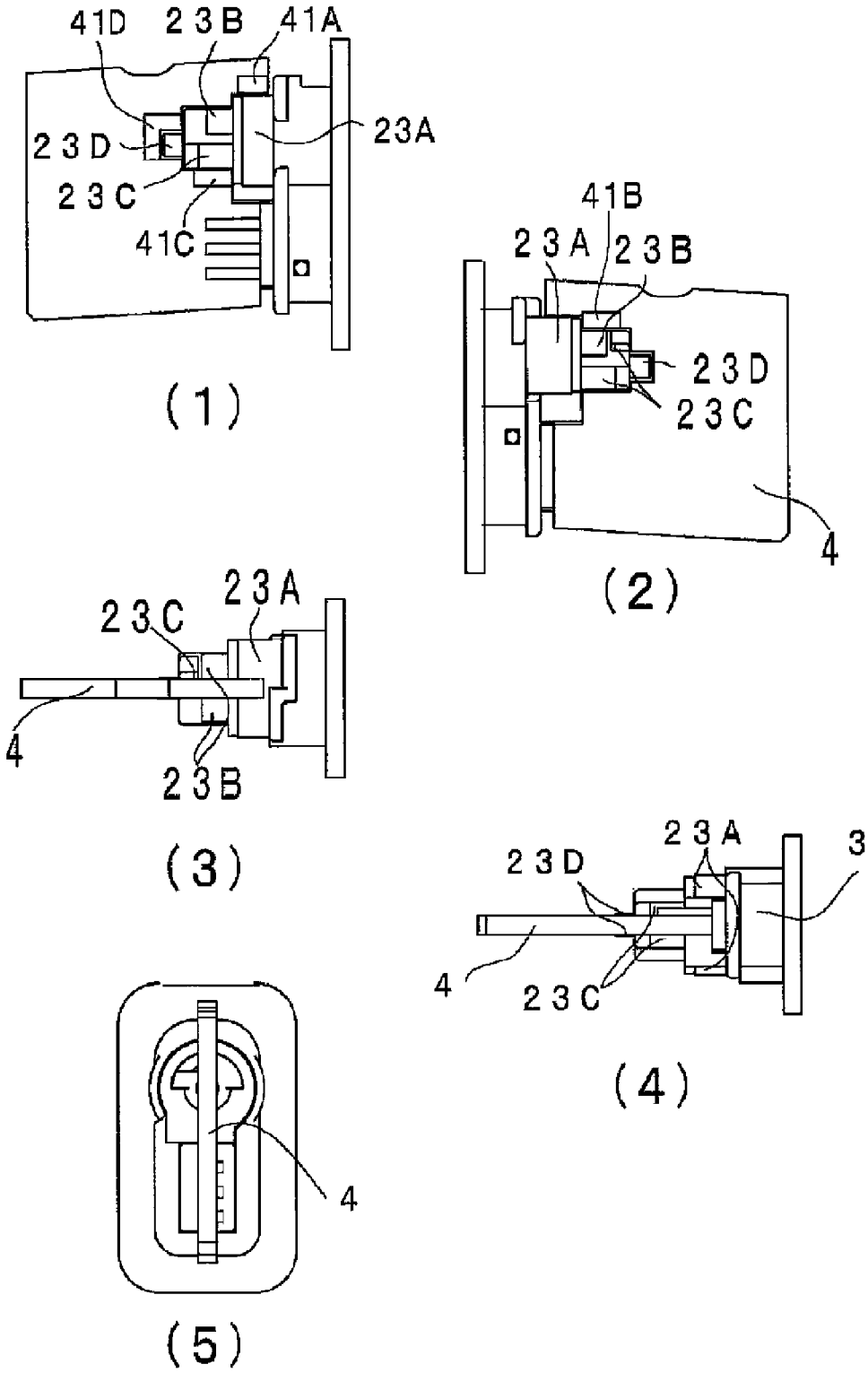
FIG. 4 shows (1) an enlarged front view of connection electrode sections connected to a substrate (solder is omitted), (2) a rear view, (3) a top view, (4) a bottom view and (5) a left-side view.
Figure 5:
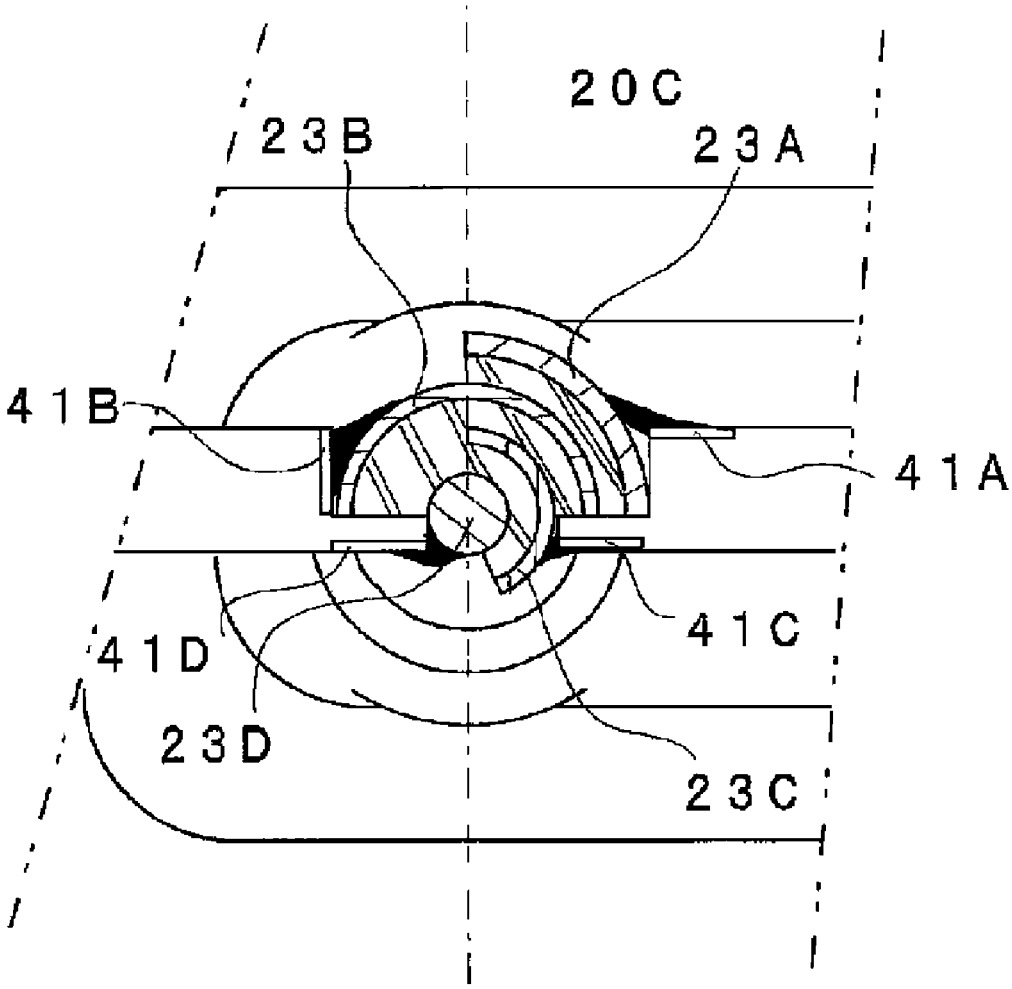
FIG. 5 shows a cross-sectional end view perpendicular to axis P when four connection electrode sections are arranged coaxially so as to be adjacent to each other around the axis P.

As shown in FIGS. 3(1) to 3(5), the plug includes:

a plug housing 20 that is a part of the housing 10 of the composite connector 1 made of an insulating resin; and first to fourth metal terminals 21A, 21B, 21C, and 21D that are formed integrally with the plug housing 20 and held thereby.

The first to fourth metal terminals 21A, 21B, 21C, and 21D are provided as the mating electrode group 22 of the plug 2 and include:

first to fourth mating electrode sections 22A, 22B, 22C, and 22D that are to be connected to the contacts of a mating jack;

first to fourth inner communication sections 24A, 24B, 24C, and 24D that are continuous with the mating electrode sections 22A, 22B, 22C, and 22D and embedded in the plug housing 20; and first to fourth connection electrode sections 23A, 23B, 23C, and 23D that are continuous with the inner communication sections 24A, 24B, 24C, and 24D, respectively, disposed in the connection electrode group 23 of the plug 2, and exposed to the outside so as to be connected to corresponding electrodes 41A, 41B, 41C, 41D of the substrate 4, respectively. As shown in FIG. 1(1), the central axis of the plug 2 is defined as an axis P.

The first to third metal terminals 21A, 21B, and 21C are formed mainly by drawing and have hollow tubular shapes.

The inner communication sections 24B and 24C of the second and third metal terminals 21B and 21C have diameters smaller than the diameters of the mating electrode sections 22B and 22C, respectively.

Radially extending step portions are formed so as to change the diameters of the metal terminals 21B and 21C. These step portions determine the positions of the metal terminals 21B and 21C in the direction of the axis P, and the metal terminals 21B and 21C are thereby secured.

The inner communication section 24A of the first metal terminal 21A has a diameter greater than the diameter of the mating electrode section 22A. A step portion extends radially so as to change the diameter protrudes toward a flange portion 10A, and the first metal terminal 21A is thereby secured.

The fourth metal terminal 21D is formed mainly by lathe turning and has a cylindrical shape. The fourth metal terminal 21D includes the fourth mating electrode section 22D disposed on the front side and a metal rod fitted and secured to the rear end of the fourth mating electrode section 22D. A step portion on the rear side of the fourth mating electrode section 22D determines the position of the fourth metal terminal 21D in the direction of the axis P, and the fourth metal terminal 21D is thereby secured to the plug housing 20.

The first to fourth metal terminals 21A, 21B, 21C, and 21D are mutually insulated through insulating sections 20C and extend in the direction of the axis P of the plug 2. These metal terminals 21A, 21B, 21C, and 21D have different diameters at the same axial position and are disposed coaxially in the plug housing 20.

In a portion in which the first to fourth metal terminals 21A, 21B, 21C, and 21D mutually overlap in the direction perpendicular to the direction of the axis P, the first metal terminal 21A is disposed on the outermost side. The second metal terminal 21B has a cylindrical shape having the second largest diameter next to the first metal terminal 21A and is disposed directly inside the first metal terminal 21A with the resin of the plug housing 20 interposed therebetween. The third metal terminal 21C has a cylindrical shape having the third largest diameter next to the first and second metal terminals 21A and 21B and is disposed directly inside the second metal terminal 21B with the resin of the plug housing 20 interposed therebetween. The fourth metal terminal 21D is a metal rod having the smallest diameter and is disposed directly inside the third metal terminal 21C with the resin of the plug housing 20 interposed therebetween.

The mating electrode group 22 includes the first to fourth mating electrode sections 22A, 22B, 22C, and 22D arranged from its base portion to its tip end portion and each having a cylindrical shape. The first to third mating electrode sections 22A, 22B, and 22C have the same diameter and the same axial length, and the fourth mating electrode section 22D is a metal piece extending in the front portion of the mating electrode group 22.

The four connection electrode sections 23A, 23B, 23C, and 23D are formed by the inner communication sections 24A, 24B, 24C, and 24D extending to the rear end side of the connection electrode group 23 of the plug 2 and being exposed to the outside. The connection electrode sections 23A, 23B, 23C, and 23D are connected by soldering to the electrodes 41A, 41B, 41C, of 41D of the substrate 4 that is a connection member used in the present embodiment.

The first connection electrode section 23A is the end portion extending from the tubular first inner communication section 24A disposed on the outermost side with respect to the axis P and is exposed to the outside. Among the four connection electrode sections 23A, 23B, 23C, and 23D, the first connection electrode section 23A has the smallest curvature and is disposed on the frontmost side in the connection electrode group 23. The first connection electrode section 23A extends so as to have the same diameter as the diameter of the first mating electrode section 22A and has the same curvature as that of the first mating electrode section 22A. A substantially central bottom part of the first connection electrode section 23A is covered with the plug housing 20.

The second connection electrode section 23B extends from one end of the second inner communication section 24B so as to be exposed to the outside and is located at the central part between the first connection electrode section 23A and the fourth connection electrode section 23D in the direction of the axis P of the connection electrode group 23. More specifically, the second connection electrode section 23B is formed by cutting out the bottom half (about 180°) of the rear end portion of the cylindrical second inner communication section 24B such that the remaining top half (about 180°) is exposed to serve as the second connection electrode section 23B. In this manner, the second connection electrode section 23B having the same curved surface shape as the second inner communication section 24B is formed.

The third connection electrode section 23C extends from one end of the third inner communication section 24C so as to be exposed to the outside and is located at the center portion between the first connection electrode section 23A and the fourth connection electrode section 23D in the direction of the axis P of the connection electrode group 23. More specifically, the third connection electrode section 23C is formed by covering the top half (about 180°) of the rear end portion of the tubular third inner communication section 24C with the plug housing 20, so that the bottom half (about 180°) is exposed to the outside to serve as the third connection electrode section 23C. In this manner, the third connection electrode section 23C having the same curved surface shape as the third inner communication section 24C is formed.

The second and third connection electrode sections 23B and 23C are disposed around the axis P so as to surround the axis P side by side, and the third connection electrode section 23C occupies about 180°) of the circumference of the axis P. In this manner, the overall length of the plug in the direction of the axis P can be reduced by a length substantially equal to the length of one electrode section.

When the second and third connection electrode sections 23B and 23C disposed coaxially with the axis P are soldered to the substrate 4, they can be mutually insulated through radial step portions 20B of the plug housing 20 that extend in the radial direction between the second and third connection electrode sections 23B and 23C.

The first connection electrode section 23A has a diameter greater than the diameters of the second and third connection electrode sections 23B and 23C that are adjacent to the first connection electrode section 23A in the direction of the axis P. Therefore, an axial step portion 20A of the plug housing 20 can be provided on the rear side of the first connection electrode section 23A, and the first connection electrode section 23A can be insulated from the adjacent second and third connection electrode sections 23B and 23C.

The fourth connection electrode section 23D having the smallest diameter is an end portion extending from the innermost fourth inner communication section 24D so as to be exposed to the outside, and is disposed on the rearmost side of the connection electrode group 23. The fourth connection electrode section 23D is a part of the metal rod used as the fourth inner communication section 24D, and the entire circumference of the fourth connection electrode section 23D around the axis P is exposed. Accordingly, the fourth connection electrode section 23D has the same curved surface shape as the fourth inner communication section 24D. The fourth connection electrode section 23D is disposed on the rear side of the second and third connection electrode sections 23B and 23C.

The fourth connection electrode section 23D has a diameter smaller than the diameters of the second and third connection electrode sections 23B and 23C that are adjacent to the fourth connection electrode section 23D in the direction of the axis P. Therefore, an axial step portion 20A of the plug housing 20 can be provided on the front side of the fourth connection electrode section 23D, and the fourth connection electrode section 23D can thereby be insulated from the adjacent second and third connection electrode sections 23B and 23C.

A cut-out portion 42 of the substrate 4 is formed so as to be slightly greater than the front shape of the connection electrode group 23. The electrodes 41A, 41C, and 41D of the substrate 4 that correspond to the first, third, and fourth connection electrode sections 23A, 23C, and 23D are disposed on the front surface of the substrate 4. The electrode 41B corresponding to the second connection electrode section 23B is disposed on the rear surface.

To mount the above components on the substrate 4, the connection electrode group 23 is first inserted into the cut-out portion 42.

More specifically, the axis P is placed at the widthwise center of the substrate 4. Then, the positions of the connection electrode group 23 and the substrate 4 are adjusted using a jig (not shown) such that the four electrodes 41A, 41B, 41C, and 41D of the substrate 4 are adjacent to the corresponding four connection electrode sections 23A, 23B, 23C, and 23D of the plug 2.

In this state, the curved surfaces of the connection electrode sections 23A, 23B, 23C, and 23D are adjacent to the corresponding electrodes 41A, 41B, 41C, and 41D that are placed horizontally with respect to the curved surfaces. Then molten solder is poured between the curved surfaces of the connection electrode sections 23A, 23B, 23C, and 23D and the flat surfaces of the electrodes 41A, 41B, 41C, 41D to form solder fillets.

The first connection electrode section 23A is soldered to the first electrode 41A disposed on the front surface of the substrate 4 and to the top side of the first connection electrode section 23A.

The second connection electrode section 23B is soldered to the second electrode 41B disposed on the rear surface of the substrate 4 and to the top side of the second connection electrode section 23B.

The third connection electrode section 23C is soldered to the third electrode 41C disposed on the front surface of the substrate 4 and to the bottom side of the third connection electrode section 23C.

The fourth connection electrode section 23D is soldered to the fourth electrode 41D disposed on the front surface of the substrate 4 and to the top left side of the fourth connection electrode section 23D.

The first to fourth connection electrode sections 23A, 23B, 23C, and 23D are disposed evenly on both sides of the substrate 4. Therefore, each of the corresponding electrodes 41A, 41B, 41C, 41D can be appropriately disposed on any side of the substrate 4, and the design flexibility is thereby improved.

By soldering the first and fourth connection electrode sections 23A and 23D on the front side and soldering the second connection electrode section 23B adjacent to these first and fourth connection electrode sections 23A and 23D in the direction of the axis P on the rear side, the first, second, and fourth connection electrode sections 23A, 23B, and 23D can be insulated from each other.

The electrodes 41A, 41B, 41C, and 41D of the substrate 4 are disposed on the front or rear side, but this is not a limitation. These electrodes may be routed on the inner surface of the cut-out portion 42 as through-holes. In this case, molten solder is poured into the gaps between the flat electrodes formed on the inner surface of the cut-out portion 42 and the curved surfaces of the connection electrode sections to form solder fillets.

In the present embodiment, the connection electrode group 23 is accommodated in the cut-out portion 42 and soldered to the substrate 4 for the purpose of reducing the height, but this is not a limitation. The connection electrode group 23 may be placed directly on one of the front and rear surfaces of the substrate 4 and then soldered. Alternatively, a hole may be formed by cutting a part of the surface of the substrate 4 to accommodate into the hole a protruding part of the large-diameter first connection electrode section 23A that protrudes from the second and third connection electrode sections 23B and 23C. In this case, the second to fourth connection electrode sections 23B, 23C, and 23D are surface-mounted on the surface of the substrate 4.

In the present invention, a connection member may be directly soldered to the connection electrode group 23. Although the workability of this method is not better than that of the above embodiment, the length in the direction of the axis P can be reduced.

In the above embodiment, the 4-pole plug 2 is used, but the invention is not limited thereto. The present invention is applicable to, for example, a 3-pole plug 2, 2-, 5-, and 6-pole plugs, and other plugs.

What is claimed is:

1. A plug, comprising a plug housing and a metal terminal group, wherein the metal terminal group comprises a mating electrode group on a first end of the metal terminal group and a connection electrode group on a second end of the metal terminal group, the mating electrode group including mating electrode sections that are disposed with an insulator interposed therebetween and that are to be in contact with contacts of a mating jack, the connection electrode group including connection electrode sections that are disposed with an insulator interposed therebetween and that are to be connected to electrodes of a connection member, the mating electrode sections are disposed coaxially with an axis of the plug, at least two of the connection electrode sections are disposed around the axis so as to surround the axis, such that one of the connection electrode sections surrounds the other connection electrode section, wherein the metal terminal group further comprises first to fourth metal terminals, first, second, third, and fourth mating electrode sections are disposed in the stated order from a rear side of the mating electrode group to a front side thereof, the first metal terminal has a largest diameter and has a rear end serving as a first connection electrode section that is disposed in a front end of the connection electrode group, the second metal terminal has a second largest diameter and has a rear end in which is formed a cut-out portion, a second connection electrode section is a remaining portion of the rear end of the second metal terminal, and is disposed on a rear side of the first connection electrode section, the third metal terminal has a second smallest diameter and has a rear end serving as a third connection electrode section that is disposed in the cut-out portion, the fourth metal terminal has a smallest diameter and has a rear end serving as a fourth connection electrode section that is exposed at a rear end of the connection electrode group, an axial step portion is provided between the first connection electrode section and each of the second and third connection electrode sections, radial step portions are provided between the second and third connection electrode sections, and another axial step portion is provided between the fourth connection electrode section and each of the second and third connection electrode sections.

2. The plug according to claim 1, further comprising a substrate as the connection member.

3. The plug according to claim 2, wherein the substrate has a cut-out portion and includes electrodes that have flat surfaces and that are disposed on an inner surface of the cut-out portion or in a periphery of the cut-out portion, the connection electrode group is accommodated in the cut-out portion of the substrate, the connection electrode sections have cylindrical curved surfaces and are adjacent to the electrodes of the substrate, and the curved surfaces are soldered to the flat surfaces.

4. The plug according to claim 3, wherein at least one of the connection electrode sections has a shape extending on front and rear sides of the substrate so as to surround the axis.

5. The plug according to claim 3, wherein each pair of the connection electrode sections adjacent in a direction of the axis are soldered on different surfaces on the front and rear sides of the substrate.

6. The plug according to claim 1, wherein the insulator comprises an insulating resin.

* * * * *